US009554621B2

(12) United States Patent
Truelsen

(10) Patent No.: US 9,554,621 B2
(45) Date of Patent: Jan. 31, 2017

(54) MIDSOLE FOR A RUNNING SHOE

(75) Inventor: Ejnar Truelsen, Tønder (DK)

(73) Assignee: ECCO SKO A/S, Bredebro (DK)

( * ) Notice: Subject to any disclaimer, the term of this patent is extended or adjusted under 35 U.S.C. 154(b) by 667 days.

(21) Appl. No.: 12/864,013

(22) PCT Filed: Feb. 20, 2009

(86) PCT No.: PCT/DK2009/000046

§ 371 (c)(1),
(2), (4) Date: Jul. 22, 2010

(87) PCT Pub. No.: WO2009/106075

PCT Pub. Date: Sep. 3, 2009

(65) Prior Publication Data

US 2010/0293811 A1 Nov. 25, 2010

(30) Foreign Application Priority Data

Feb. 27, 2008 (DK) ..... 2008 00279
Jul. 5, 2008 (DK) ..... 2008 00948

(51) Int. Cl.

| | |
|---|---|
| ***A43B 5/06*** | (2006.01) |
| ***A43B 7/24*** | (2006.01) |
| ***A43B 13/12*** | (2006.01) |
| ***A43B 13/18*** | (2006.01) |
| ***A43B 23/08*** | (2006.01) |

(Continued)

(52) U.S. Cl.

CPC ..... *A43B 13/026* (2013.01); *A43B 5/06* (2013.01); *A43B 7/24* (2013.01); *A43B 13/12* (2013.01); *A43B 13/148* (2013.01); *A43B 13/188* (2013.01); *A43B 21/24* (2013.01); *A43B 23/088* (2013.01)

(58) Field of Classification Search

CPC ..... A43B 7/14; A43B 7/24; A43B 13/00; A43B 13/14; A43B 23/08; A43B 23/088; A43B 5/06; A43B 13/12; A43B 13/148; A43B 13/188

USPC ..... 36/25 R, 28, 30 R, 30 A, 31, 69

See application file for complete search history.

(56) References Cited

U.S. PATENT DOCUMENTS 2,156,086 A * 4/1939 Hack et al. ..... 36/171
4,366,634 A 1/1983 Giese et al.

(Continued)

FOREIGN PATENT DOCUMENTS

| | | | |
|---|---|---|---|
| FR | 2802781 | A1 | 6/2001 |
| JP | 2001-29110 | A | 2/2001 |
| WO | 94/04051 | A1 | 3/1994 |

*Primary Examiner* — Khoa Huynh
*Assistant Examiner* — Sharon M Prange
(74) *Attorney, Agent, or Firm* — Cantor Colburn LLP

(57) ABSTRACT

A midsole for a running shoe is described, which shoe comprises a rear foot area (150) with a bottom heel portion (20) and an upper heel portion (142). The upper heel portion (142) is molded in one piece with the bottom heel portion and extended vertically to cover the tuberosity (68) of the calcaneus (69). According to the invention, the upper heel portion (142) is asymmetric about a vertical axis (B-B) dividing the midsole (1) into two halves wherein the area of midsole material supporting the heel on the medial side (143) of the upper heel portion (142) is larger than the supporting area of the midsole material on the lateral side (151) of the upper heel portion. This design stabilizes the foot during motion, and contributes to lowering the risk of injury during running.

18 Claims, 14 Drawing Sheets

Figure 1A:
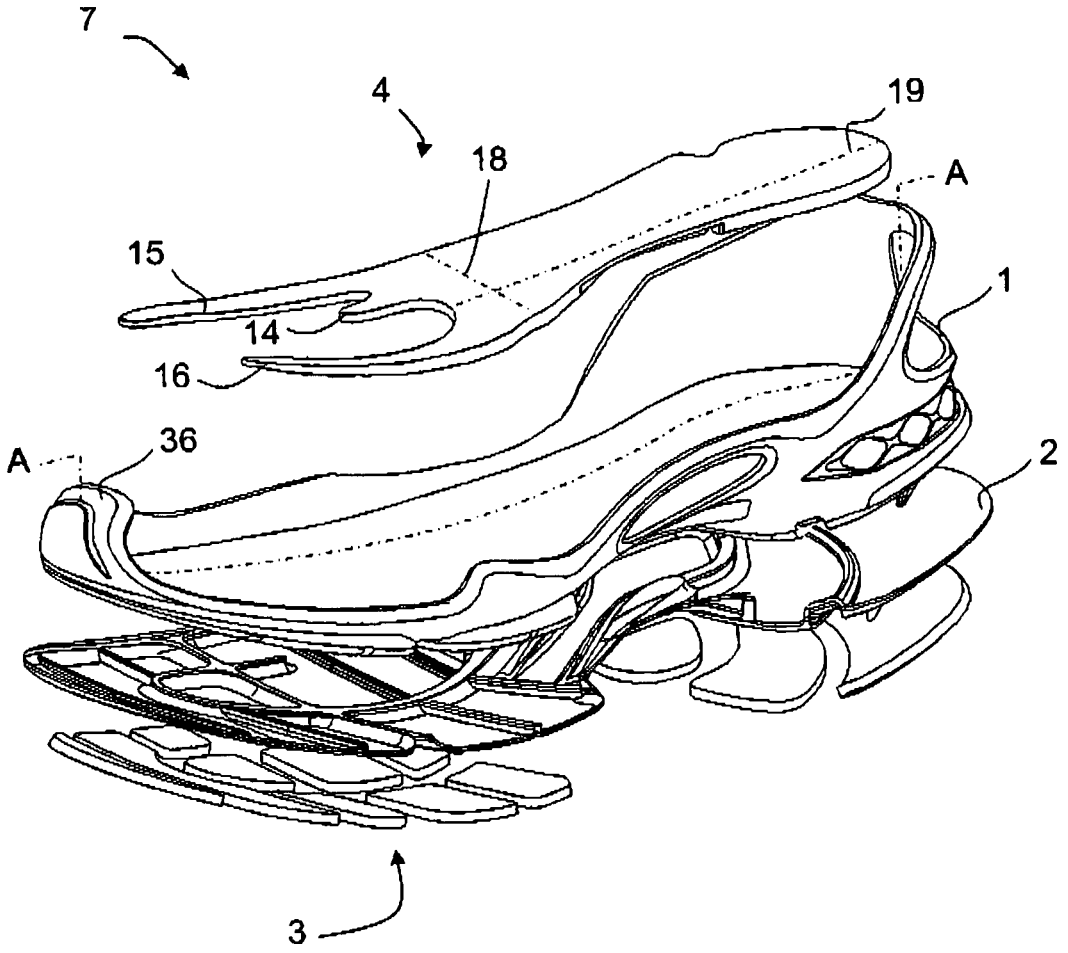

(51) Int. Cl.

| | |
|---|---|
| ***A43B 13/14*** | (2006.01) |
| ***A43B 13/02*** | (2006.01) |
| ***A43B 21/24*** | (2006.01) |

(56) References Cited

U.S. PATENT DOCUMENTS

| | | | | | |
|---|---|---|---|---|---|
| 4,638,576 | A | * | 1/1987 | Parracho et al. | 36/68 |
| 4,694,591 | A | * | 9/1987 | Banich et al. | 36/102 |
| 4,731,939 | A | * | 3/1988 | Parracho et al. | 36/31 |
| 4,741,114 | A | * | 5/1988 | Stubblefield | 36/32 R |
| 4,798,010 | A | * | 1/1989 | Sugiyama | 36/30 R |
| 5,384,973 | A | | 1/1995 | Lyden | |
| 5,797,199 | A | * | 8/1998 | Miller et al. | 36/28 |
| 5,884,420 | A | * | 3/1999 | Donnadieu | 36/117.5 |
| 6,108,943 | A | | 8/2000 | Hudson et al. | |
| 6,199,302 | B1 | * | 3/2001 | Kayano | 36/28 |
| 7,444,767 | B2 | * | 11/2008 | Kilgore et al. | 36/30 R |
| 7,954,259 | B2 | * | 6/2011 | Antonelli et al. | 36/69 |
| 2001/0032399 | A1 | | 10/2001 | Litchfield et al. | |
| 2008/0016724 | A1 | * | 1/2008 | Hlavac | 36/30 R |
| 2009/0293309 | A1 | * | 12/2009 | Keating et al. | 36/88 |

* cited by examiner

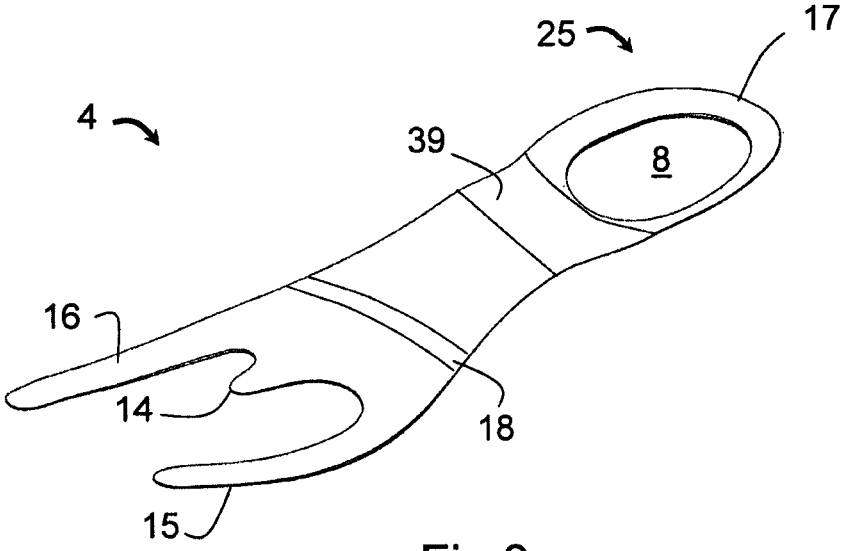
Fig.3a
Fig.3b
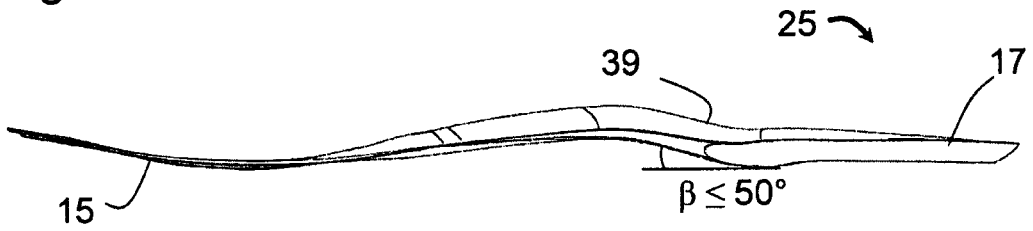
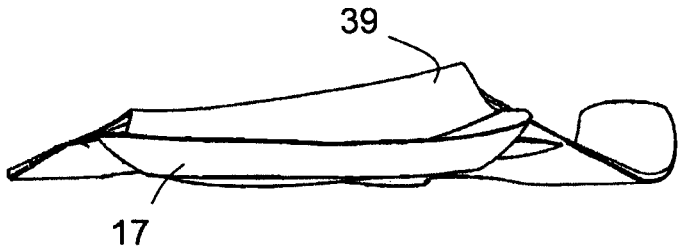
Fig.3c

Fig.10
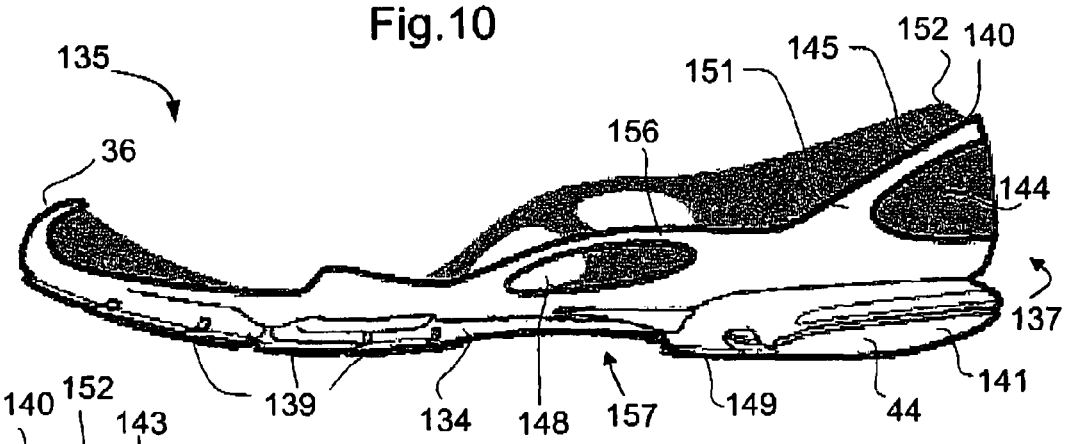
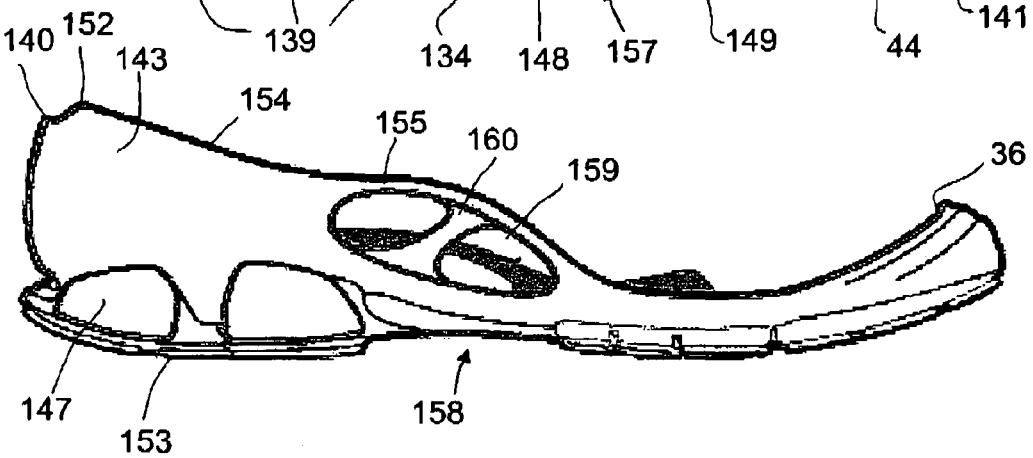
Fig.11

Fig.13
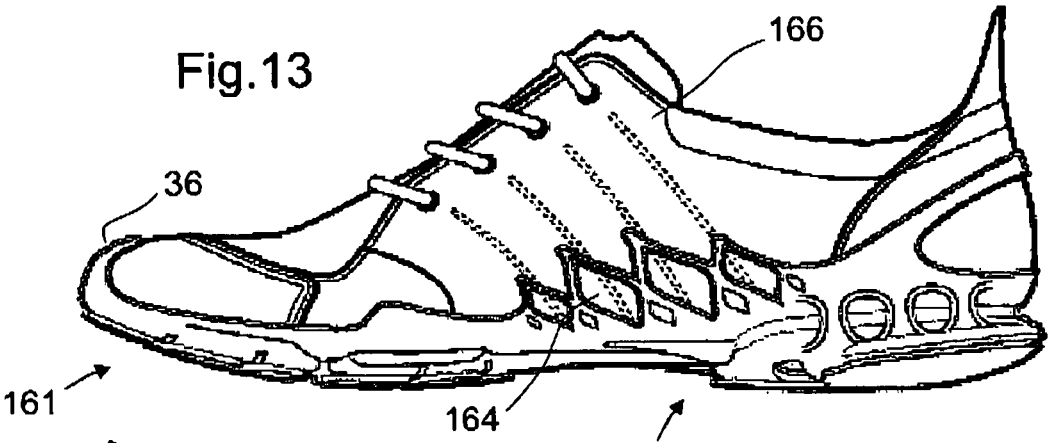
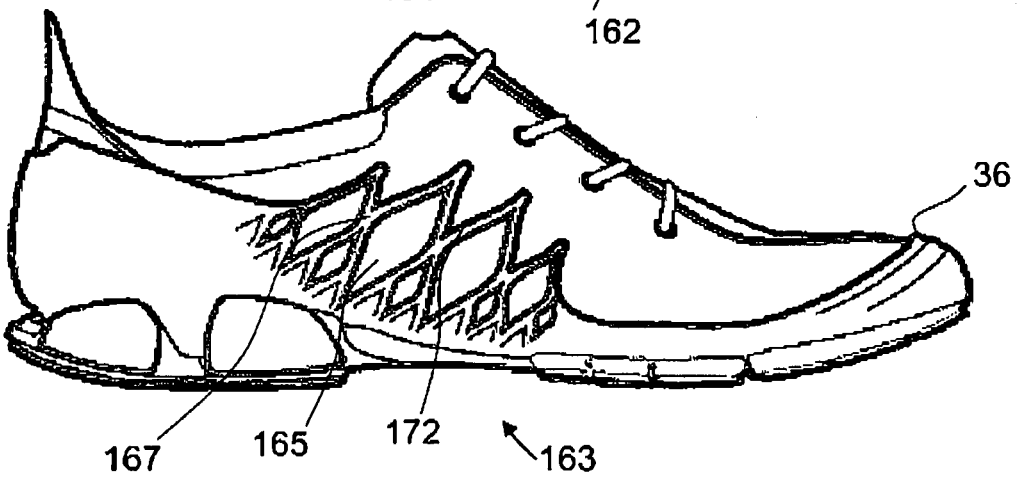
Fig.12

MIDSOLE FOR A RUNNING SHOE

This is a National Phase Application filed under 35 U.S.C. 371 as a national stage of PCT/DK2009/000046, filed Feb. 20, 2009, an application claiming foreign priority benefits under 35 USC 119 of Danish Application No. PA 2008 00279, filed Feb. 27, 2008 and claiming foreign priority benefits under 35 USC 119 of Danish Application No. PA 2008 00948, filed Jul. 5, 2008, the content of each of which is hereby incorporated by reference in its entirety.

The invention concerns a midsole for a running shoe. One type of running shoes of the state of the art has in common the concept of protection of the foot. More precisely, the shoe is considered a sheltering instrument for the foot. This protection concept has lead to relatively heavy running shoes, which often have a sole or insole with a high degree of cushioning in order to mitigate the force reactions stemming from the heel strike and acting on the ankle joint and the leg. Another type of running shoes are ultra lightweight shoes which often are below 300 grams. This type is minimalist having thin soles and thin uppers. When designing shoes, the shoe industry has for a long period had the natural moving foot as the ideal state of motion, e.g. barefoot running on grass, where the foot unconstrained by a shoe is allowed to perform its natural motion. However, once the shoe is on the foot, natural motion of the foot is impeded. As an example, the angle of the metatarsal phalangeal joint is reduced considerably when wearing shoes. The metatarsal joint angle is the angle between the ground and the metatarsal phalanges. If measured at the instant just before pushing off from the ground, this angle is in barefoot running close to 60 degrees and in so called technical or athletic running, where running shoes are used, reduced to only 35 degrees. Impediment of the natural motion of the foot means among other things that the muscles of the leg and foot which are active during barefoot running are also constrained. These muscles are not allowed to act with their full strength, and thus the shoe, if wrongly designed, will limit the ability of the runner to move efficiently. His performance is lowered as compared to barefoot running. Some of the key muscles during walking and running are musculus flexor hallucis longus and musculus extensor hallucis longus. The importance of these strong muscles when considering barefoot running in relation to running with shoes has already been acknowledged in U.S. Pat. No. 5,384,973, which is incorporated herein by reference. More specifically U.S. Pat. No. 5,384,973 describes a midsole for a running shoe which sole has a multiple of flex joints or grooves in longitudinal and transversal direction. A number of discrete outsole elements are connected to the midsole. This structure allows the toes of the foot to act independently and to increase the stability of the shoe. In particular, the flex joints have created an isolated sole area for the hallux, hereby allowing flexor hallucis and extensor hallucis longus to play a greater role during running. U.S. Pat. No. 5,384,973 describes the relatively thick midsole of current running shoes as a reason for instability leading to risk of injuries. In order to reduce this risk, U.S. Pat. No. 5,384,973 provides as already described a solution with flex joint grooves in the sole and particularly along the hallux between the first and second toe. This prior art solution is an improvement over earlier prior art, in that injuries from running can be lowered. Other measures can be taken in order to lower the risk of injury. U.S. Pat. No. 6,108,943 describes a sports shoe which is asymmetric and has a midsole with, distinctly performing lateral and medial portions. However, the midsole is made of a soft foam material with cushioning material in order to cushion the impact forces. While this solution may work well in some sports as tennis, cushioning is not an optimum way to reduce the risk of injury during running, because cushioning absorbs too much energy from the runner.

In the light of the foregoing, the present invention sets out to solve the problem of how to reduce further the risk of injury during running.

This is achieved with a midsole according to claim 1.

The invention has its starting point in the basic assumption that natural running is the ideal situation, and that a sole should be designed in a way that brings running as close to the ideal situation as possible. Instead of extensive cushioning in running shoes, or extreme reduction of the weight, a concept of supporting the foot in its natural motion during running has been developed. The midsole of the present invention is characterized by a midsole which has an upper heel portion moulded in one piece with the bottom heel portion. Extending the upper heel portion to vertically cover the tuberosity of the human calcaneus, and having the area of midsole material supporting the heel on the medial side of the upper heel side larger than the supporting area of the midsole material on the lateral side has the advantage, that the midsole firmly supports the heel. This extended midsole heel so to speak grabs around the human heel and follows its motions intimately. Due to the larger material surface on the medial side of the heel, support is given already at heel strike when the foot moves from typically the lateral side towards the medial side into pronation. As the midsole is made from a material with a higher stiffness than textile, the material around the tuberosity will structurally and mechanically support the foot. Preferably, polyurethane is used. The risk of damage to the ankle is reduced due to the improved support.

The invention further has the advantage, that the heel cap used in conventional shoes for stabilization can be omitted, saving weight and cost.

In order to support the concept of getting close to natural running, extensive data had to be collected and turned into practical measures. The last used for the inventive sole is a so called anatomical last which means that is has a higher degree of similarity to the foot compared to a normal foot shaped last. In other words, the anatomical last is in shape very close to the human foot. The high degree of similarity has been achieved by measuring 2200 feet. By examination of the many data from the feet we have created so to speak "an average human foot" and put this shape into the last. During manufacturing of the shoe, the midsole material, which is injected, will follow the shape of the anatomical last and hereby take the shape of the average human foot. The foot sole will rest comfortably on the manufactured midsole, because the midsole is a mirror of the foot sole Preferably, the midsole contains an opening on the lateral side of the upper heel portion. This arrangement has two advantages. Firstly, weight can be reduced of the midsole, and secondly flexibility of the midsole in the heel area is achieved during heel strike. The opening allows the upper heel portion to be deformed without loosing the stabilizing characteristic of the heel area. In order to support the opening, a structural arm of midsole material surrounds part of the opening.

A characteristic of the lower heel portion of the midsole is its asymmetric design about a vertical axis running through the centre of the heel. The bottom of this lower heel portion is tapered in a direction towards the lateral side and in a direction towards the heel end. This characteristic is contributing to moving the point of landing of the foot more centrally below the heel.

Preferably, the lower heel portion on the lateral side extends laterally longer than the upper heel portion. This contributes to the asymmetric look, and has the technical function of stabilizing the foot.

A further stabilizing feature is provided by providing the lower heel portion with two or more steps staggered in relation to each other. With this feature a characteristic "edge" phenomenon of polyurethane injection is utilized. In such edges with 90 degrees angles or thereabout, the polyurethane tends to get more stiff than in non-edge areas. Thus, increasing the number of edges increases the stability.

Preferably the midsole not only has support in the heel area, but also in the lateral and medial area of the midfoot, where a medial and a lateral support structure is arranged. These structures enhances further the support of the foot.

The invention is now described in detail by way of the drawings in which

FIG. 1*a* is a split view of the sole with an inventive midsole and a shank

Figure 1B:
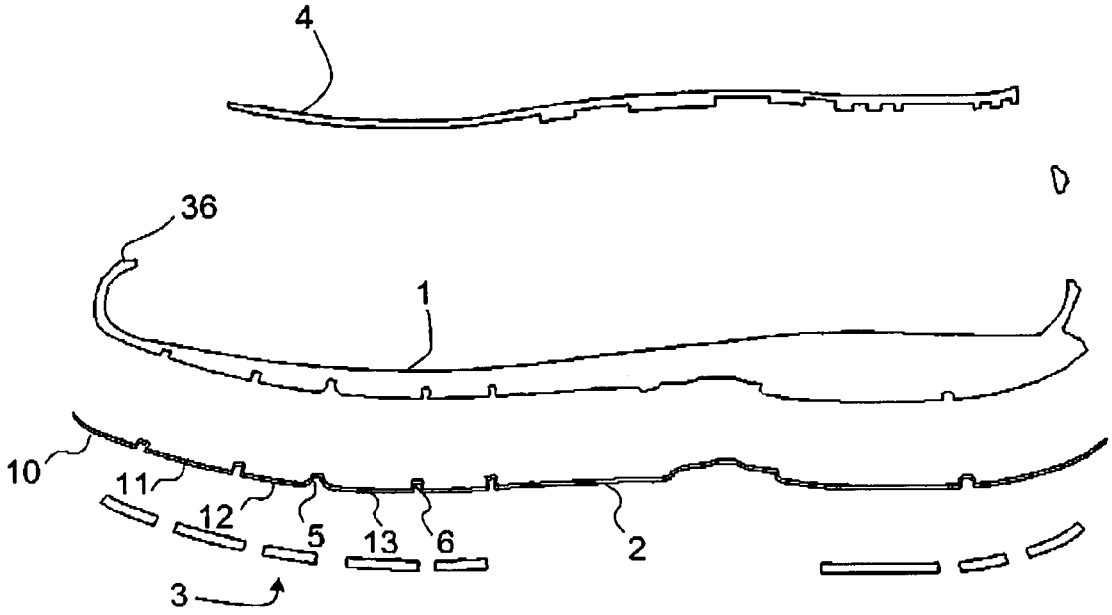

FIG. 1*b* is a cut away view of the sole of FIG. 1*a* along an axis A-A

Figure 2A:
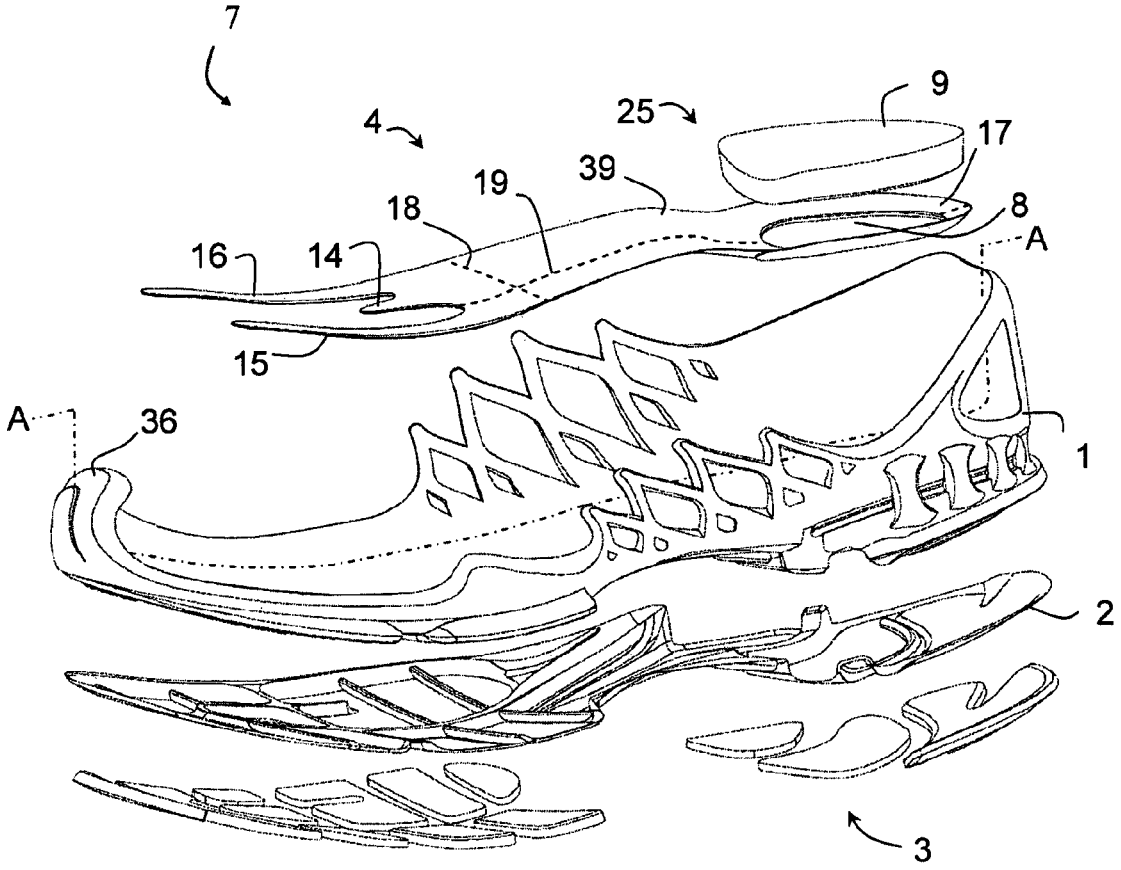
Figure 2B:
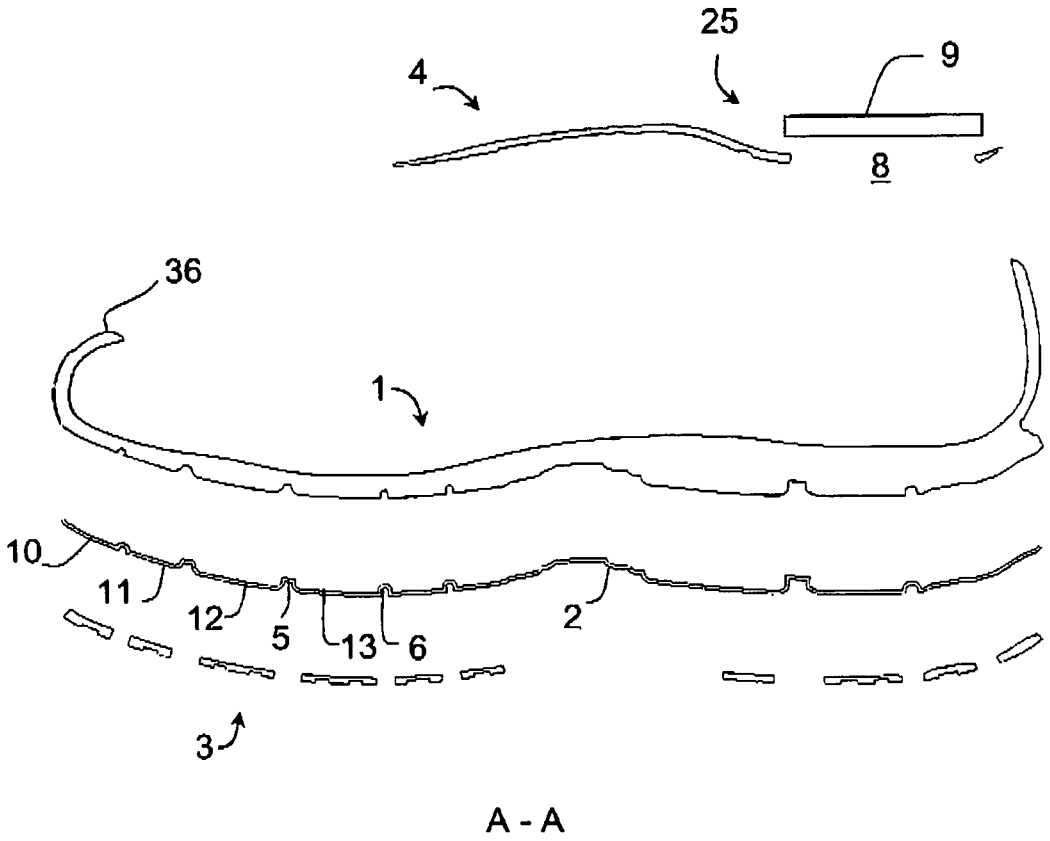
Figure 4:
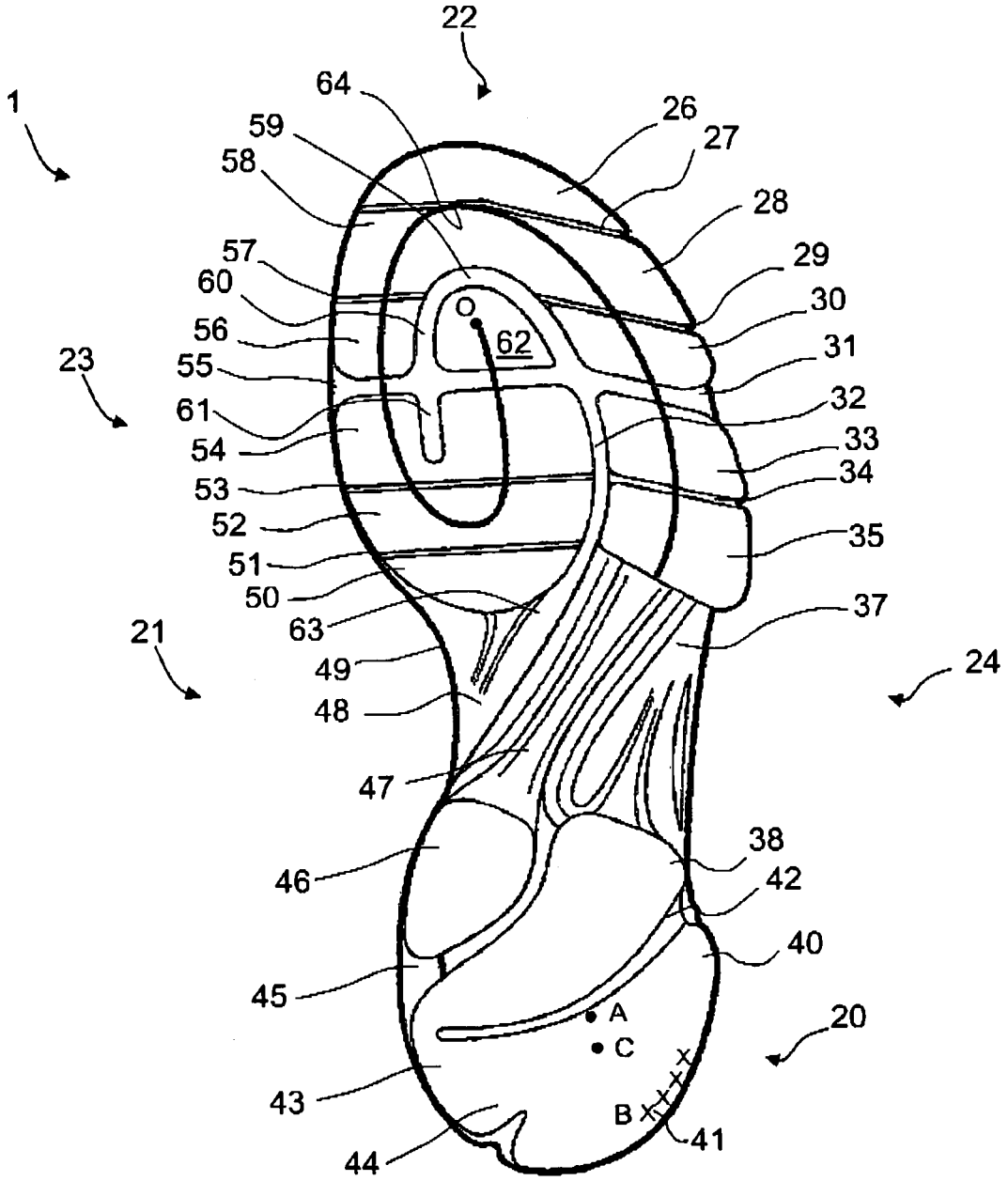
Figure 5:
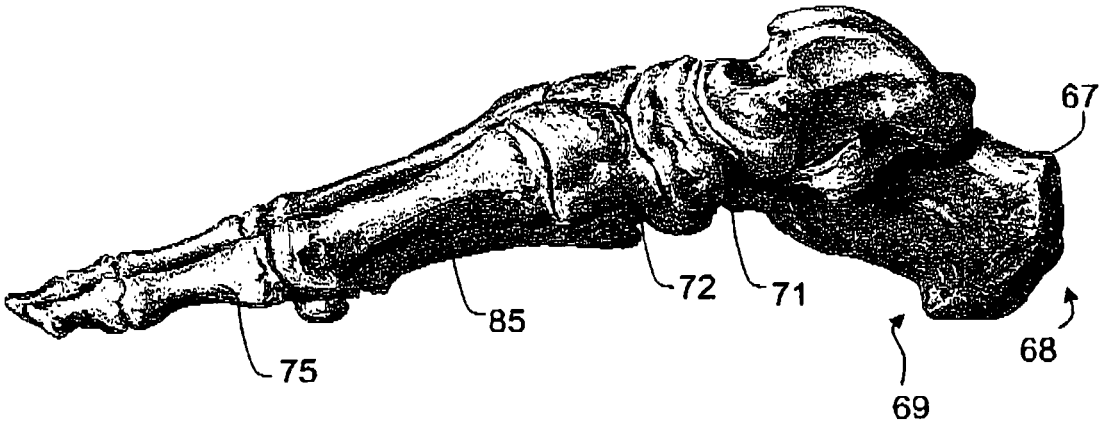
Figure 6:
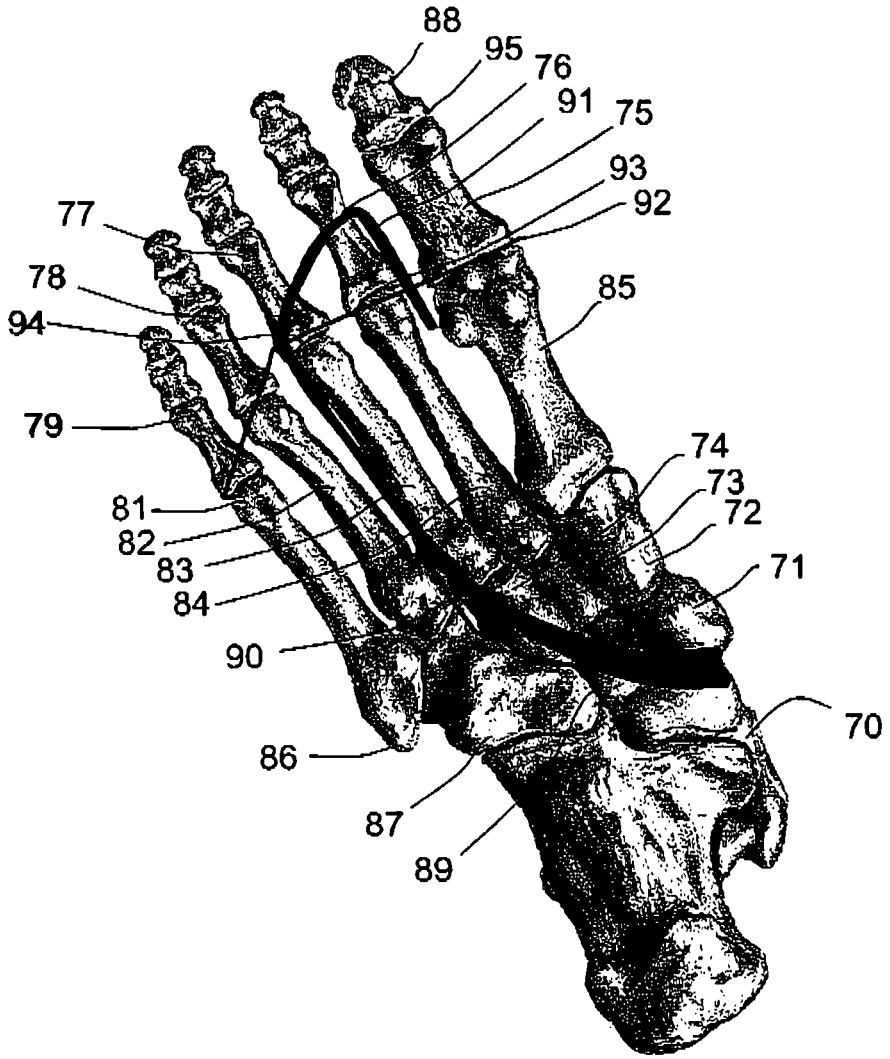
Figure 7:
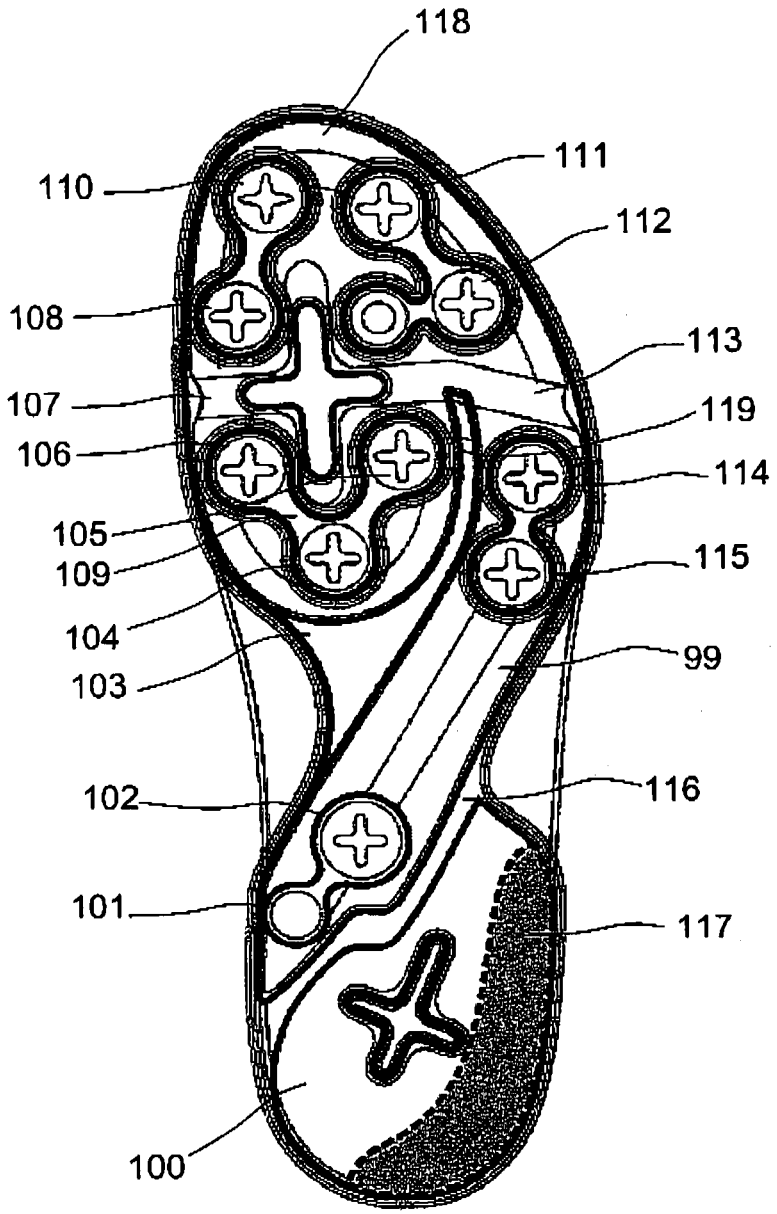
Figure 8:
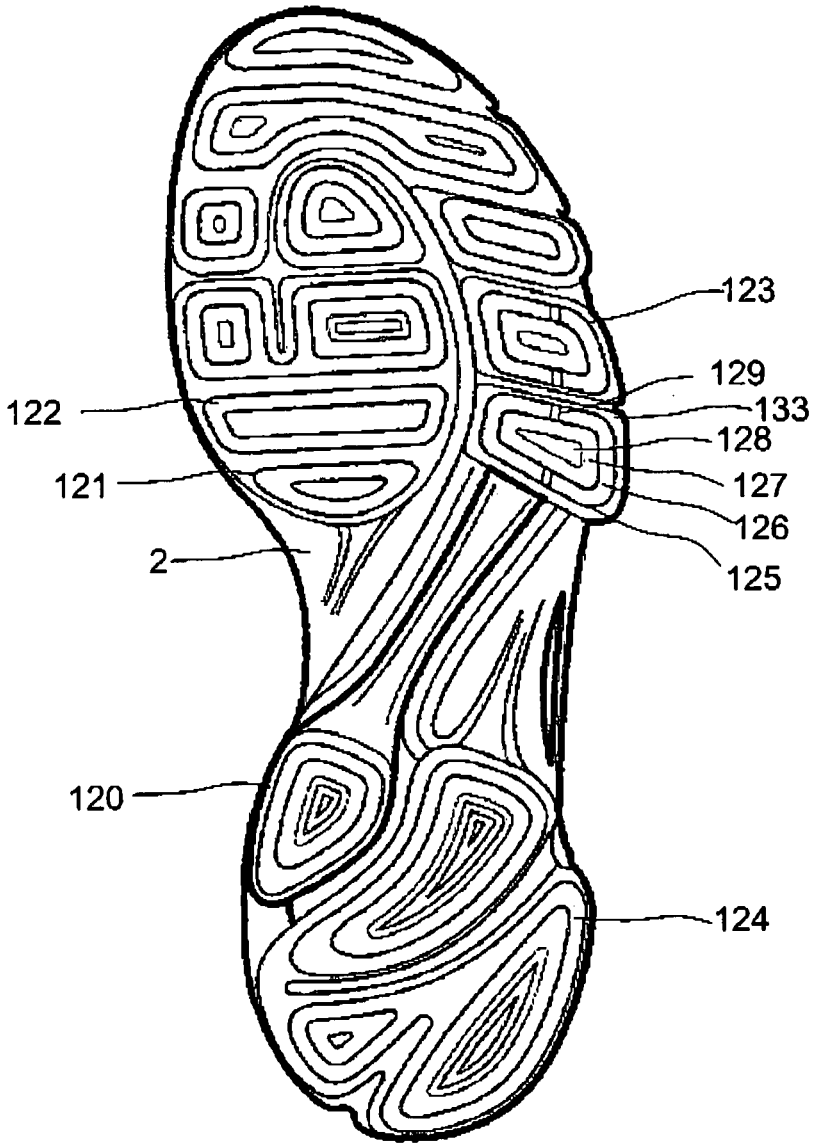
Figure 9:
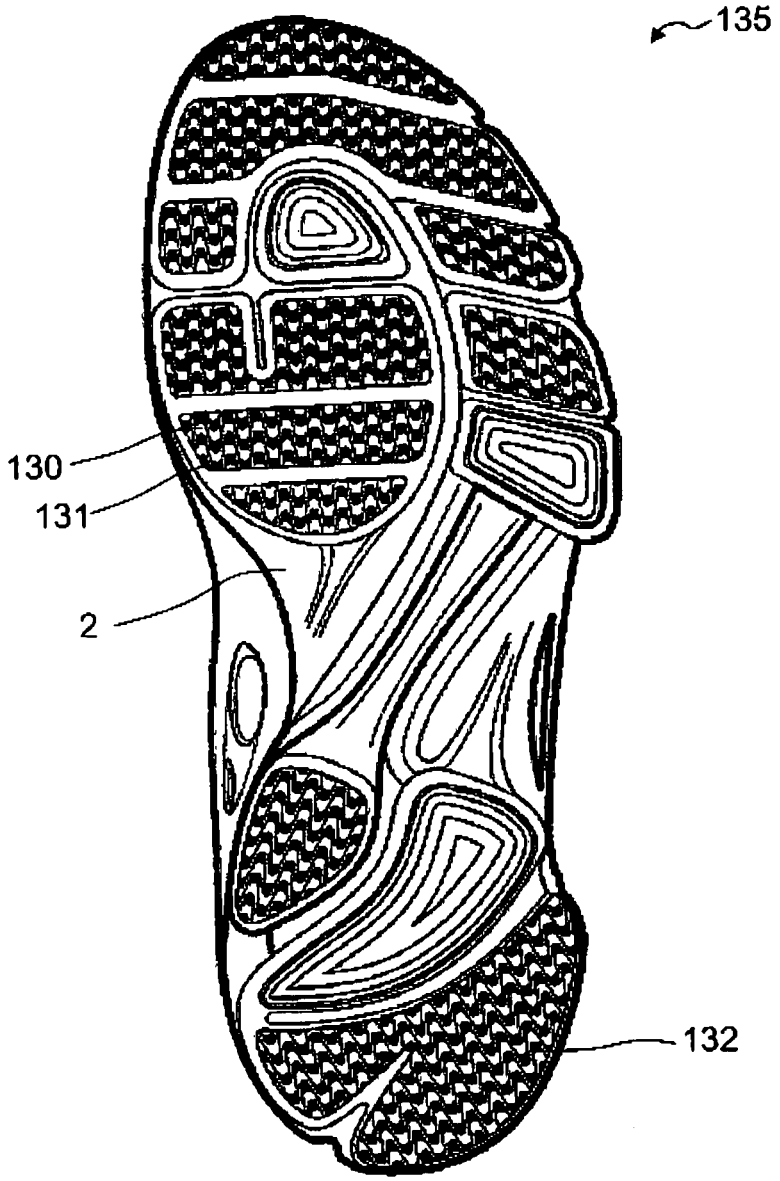
Figure 15:
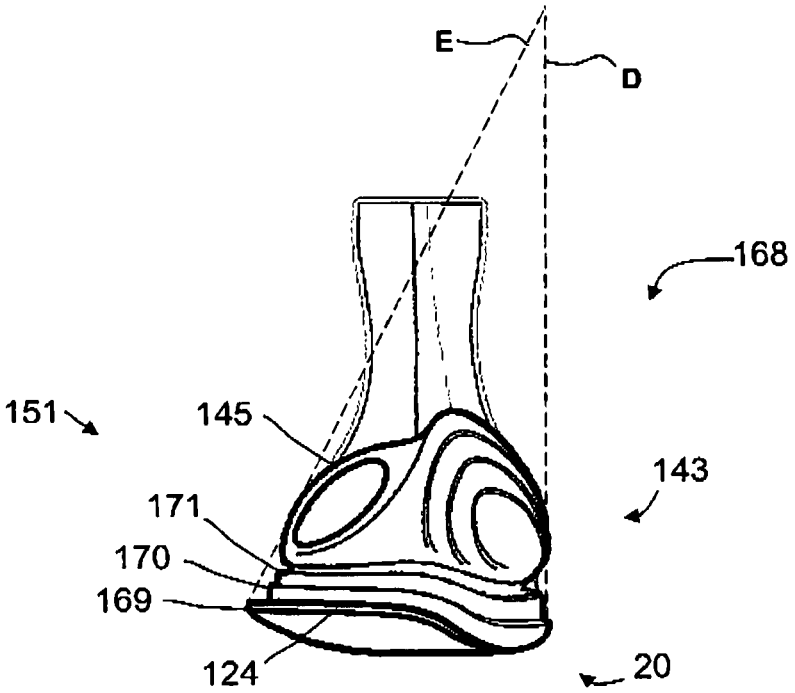
Figure 14:
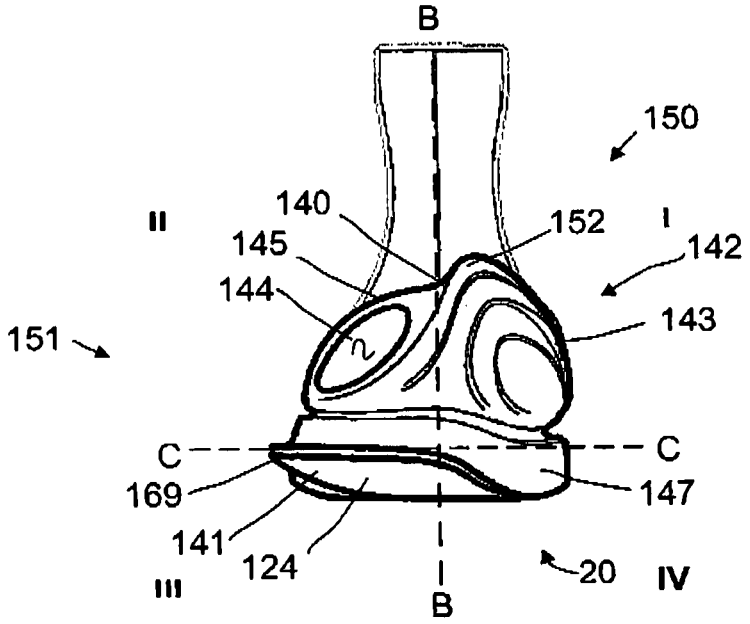

FIG. 2*a* is a split view of another sole with an inventive midsole and a shank FIG. 2*b* is a cut away view of the sole of FIG. 2*a* along an axis A-A FIG. 3*a* shows the shank used in a perspective view FIG. 3*b* shows the shank of FIG. 3*a* in a side view FIG. 3*c* shows the shank of FIG. 3*a* in a rear view FIG. 4 is a view of a first embodiment of the bottom of the inventive midsole FIG. 5 is a drawing showing the bones of the medial side of the foot FIG. 6 shows the right human foot as seen from below FIG. 7 is a second embodiment of the bottom of the inventive midsole with an outsole FIG. 8 is a third embodiment of the bottom of the inventive midsole with an outsole FIG. 9 is a fourth embodiment of the bottom of the inventive midsole with an outsole FIG. 10 is a view of the inventive midsole from the lateral side FIG. 11 is a view of the inventive midsole from the medial side FIG. 12 is a view of an alternative inventive midsole from the medial side FIG. 13 is a view of an alternative inventive midsole from the lateral side FIG. 14 is a view of a first heel embodiment of the inventive midsole FIG. 15 is a view of a second heel embodiment of the inventive midsole FIG. 1*a* is a perspective view of the sole 7. In a preferred embodiment, the sole consists of three layers, namely as first layer a midsole 1, a second intermediate layer 2, and a third layer 3 constituting the outsole. A shank 4 is placed on top of the midsole. FIG. 1*b* shows the sole in a longitudinal cut along the axis A-A of FIG. 1*a*. For reasons of clarity, the medial support structure has been cut away in the view of FIG. 1*a* but it can be seen as reference numeral 158 in FIG. 11.

Midsole 1 is in the preferred embodiment made of light polyurethane (PU) material, also called PU light. This material is a known special variant of PU which has a low density (0.36 g/cm$^3$), i.e. is a lightweight material. A further characteristic is a good return of energy absorbed from the runner, which characteristic is of importance for long distance running. Shore A hardness is between 38 and 40. Alternatively, also ethylene vinyl acetate (EVA) can be used as midsole because it has a lower specific gravity than PU light resulting in a lighter sole. However, EVA tends to quick ageing under frequent force influence from the foot. This ageing is seen as wrinkles in the material. It is not form stable, and after a while it is compressed and does not return to its original shape.

Midsole 1 is in this preferred embodiment covered with the second intermediate layer 2 which has the same profile as the midsole. FIG. 1*b* shows this profile and the second layer 2 is so to speak a replica of the bottom of the midsole 1. Layer 2 has the function of a protective layer, consists of thermoplastic polyurethane (TPU), and is an intermediate layer which is thin, typically 0.5-2 millimeters. It has a shore A value of 65 plus/minus 3.

The third layer 3 is the outsole, which consists of a number of discrete outsole elements (e.g. reference numbers 120-123 in FIG. 8), which together add up to be the outsole. Under the term "discrete outsole element" is understood a piece of outsole that is not cast or moulded in the same process as the midsole or the intermediate layer 2, but is added or bonded to e.g. layer 2 later. Further, a discrete outsole element is not connected to the other outsole elements. In more detail, the outsole 3 consists of a plurality of outsole elements which can be perceived as islands that are not interconnected, separated by one or more grooves in the midsole. The elements are preferably made of rubber. Instead of rubber, TPU can be used as material for the discrete outsole elements, but the gripping characteristics of TPU are inferior compared to rubber. The rubber used is a conventional Nitril Butadine Rubber (NBR), which is preferred for running shoes because of its relative low weight. It has a shore A value of 55 plus/minus 3. For other types of shoes, latex (comprised of a mixture of natural and synthetic rubber) can be used. The outsole elements are spaced apart with grooves 5, 6 in the intermediate TPU layer 2 and in the midsole 1, and are placed on protrusions or pads 10, 11, 12, 13 (FIG. 1*b*) made in the intermediate TPU layer. The pads and grooves of the intermediate layer mate with the corresponding pads and grooves of the midsole.

FIG. 2*a* shows another sole, which has a midsole 1 with lateral and medial support structures, and a shank 4 amended as compared to the shank in FIGS. 1*a* and 1*b*. FIG. 2*b* shows the sole of FIG. 2*a* in a cut away view. The reference numerals of FIGS. 1*a* and 1*b* are the same in FIGS. 2*a* and 2*b*.

Manufacturing of the sole 7 consisting of the sole parts 1, 2 and 3. Is made in the following way. In a first step, the TPU intermediate layer 2 and the outsole elements 3 are produced in a separate manufacturing process to become an integrated entity. In a second step, the midsole 1 is connected to the integrated entity consisting of layer 2 and outsole 3. Step one and step two will now be described.

In step one, the TPU intermediate layer 2 and the discrete outsole elements 3 are manufactured to become an integrated entity. First the discrete outsole elements are manufactured in a rubber vulcanisation process. Then the outsole elements are placed in a mould, where TPU is inserted above the elements. The mould is closed, and under application of heat and pressure the TPU is shaped into the desired shape. After a curing time, the integrated entity of outsole elements and TPU intermediate layer is finished. Although the TPU layer is manufactured in a casting process, alternative manufacturing processes are available for producing the second layer 2. Thus, the TPU can be injection moulded in a known manner, or the TPU can be a foil-like raw material like a sheet placed above the outsole elements 3 before joining these elements and the TPU using heat and pressure.

Bonding between the TPU intermediate layer 2 and the outsole elements 3 are made with glue which is activated by the heat during moulding the TPU onto the outsole elements. A simple adhesion without glue between TPU and rubber during the moulding process proved not durable. Before adding glue between TPU intermediate layer 2 and outsole elements 3, the rubber surface of the outsole elements 3 must be halogenated in a process which removes fat from the rubber and thus enhances the adhesion.

In step two of the manufacturing of sole 7, the midsole 1 is unified with the integrated entity consisting of layer 2 and outsole elements 3 from step one, as well as with a shoe upper. More specifically, the TPU intermediate layer 2 with the outsole elements 3 is placed in an injection mould together with the shoe upper, after which PU is injected into the mould and bonds to the shoe upper and the integrated entity consisting of layer 2 and outsole elements 3. The PU thus bonds to the side of the TPU intermediate layer 2 which is closest to the human foot. After this second step, sole elements 1, 2 and 3 have become integrated into one entity. Preferably, shank 4 is only partly embedded in PU during the injection process.

The TPU intermediate layer 2 has a double function in that it lowers the breakability of the midsole and reduces the cycle time on the PU injection machinery. This will be detailed in the following.

In principle, the TPU intermediate layer can be omitted, and the isolated outsole elements placed directly in the mould by the human operator before PU injection. This would however cost processing time on the PU injection machine, because placement of the many discrete outsole elements takes time. Instead, by manufacturing the TPU intermediate layer 2 and outsole elements 3 in a separate process as described above, the PU injection machine is free to manufacture midsoles most of the time. Machine waiting time is reduced. However, the use of the TPU intermediate layer has a further advantage, namely reducing a tendency of the PU light midsole to break. If the discrete outsole elements 3 are placed directly against the PU light midsole without any intermediate layer 2, the midsole tends to break in durability tests due to the higher number of flex grooves. Such breakage will allow water to enter the shoe during wear. The reason is that when injecting PU into the mould during manufacturing, air bubbles tend to occur in the midsole. The bubbles occur because the PU is not able to press out air around sharp edges in the channels of the mould. This is probably due to the low specific gravity of the PU. The result is that air bubbles are contained in the midsole, thus making the sole liable to penetration of water when the midsole breaks or experiences cracks. TPU has a larger specific gravity, and does not cause problems with trapped air bubbles during manufacture. In other words, the midsole 1 is not liable to water penetration caused by air bubbles and breakage due to protection by the intermediate layer 2, which contributes to keeping the interior of the shoe dry.

As material for midsole 1 PU has been chosen over TPU. In principle, the whole midsole could be made of TPU, but PU light has a lower specific gravity thus lowering the weight of the shoe. Further, PU has good shock absorbing characteristic which is important especially for running shoes.

Between the midsole 1 and an insole (not shown on the figures) is the shank 4 (FIGS. 3*a* to 3*c*), which consists of a mixture of thermoplastic polyethylene (TPE) and nylon and is partly flexible. It extends from the heel portion to the toes, and has in the heel portion preferably an opening 8, where the polyurethane used for the midsole 1 enters during the injection process. This feature improves the shock absorption in the heel. In the front end, the shank has two curved fingers 15 and 16 extending under a curvature in the longitudinal direction, and a small finger 14 in the middle. These fingers support in particular the first, fourth and fifth metatarsal phalanges. It has been found that two to three fingers suffice instead of having one supporting finger for each ray in the foot. The shank is designed to be "anatomical", i.e. it follows the average foot more closely than conventional shanks. The shank is manufactured in an injection process, and is made bendable in the transversal direction just where the fingers of the shank starts, corresponding to the proximal end of the first, fourth and fifth metatarsal phalanges, see the line indicated by reference number 18 in FIGS. 1*a*, 2*a* and 3*a*. Thus, the shank is bendable in a direction orthogonal to the longitudinal axis of the sole. The bend ability is achieved in a process during manufacturing of the shank, where thermoplastic polyethylene is injected from the heel end and nylon from the toe end. The two compositions meet at the bending line and the sole is bendable from this line 18 because polyester is soft compared to hard glass fibre. As a further measure, the shank is also flexible in its longitudinal direction along a line 19 (FIGS. 1*a* and 2*a*), because the shank should preferably be more flexible on the lateral side than on the medial side. With this measure, the torsional stiffness in the longitudinal direction is adjustable. FIG. 3*a* shows the small finger 14. Tests have shown that pushing off in the forefoot during running is improved by increasing the stiffness in this area of the foot.

Preferably, the shank 4 is placed on top of the midsole. Alternatively it could have been placed between the midsole 1 and the intermediate layer 2, but this placement would lead to friction problems between the human heel and the heel of the midsole. During running, the midsole would compress and decompress in the heel area, each compression allowing the human heel a movement downwards, and each decompression allowing the human heel to move upwards. Repeated movements downwards and upwards against the heel creates friction and discomfort for the runner. Instead, by placing the shank on top of the midsole, friction is lowered because the shank as an early stiffening layer reduces the length of downwards and upwards movements.

In one embodiment, the shank is integrated in the strobel sole, which is a flexible sole connected and typically sewn to the upper (not shown in the figures). The strobel sole is often a textile. The integration of the shank into the strobel sole gives a harder sole because the strobel sole contributes to the hardness. This embodiment has the advantage of an easier manufacturing, because the shank is sewn into the strobel sole and does not have to be placed in the mould before PU injection as described above. In the preferred embodiment however, the shank is glued to the strobel sole, which together with the upper is mounted on the last. The last is placed in the mould which is closed, after which PU is injected into the mould.

The shank 4 has an offset heel area 25 as shown in FIG. 3*a*. This offset heel area defines a cavity 17 for receipt of PU or other material. The offset heel area functions as a platform for the PU entering the essentially elliptically shaped opening 8. The cavity is made by a rim in the shank, which rim follows around the opening 8. The rim is sloping inwardly towards the centre of the opening, hereby defining the cavity 17. In one embodiment of the invention, the PU fully fills the cavity, which, when taken at the centre of the opening, gives the following layering in the heel area from top to outsole: strobel sole, PU, TPU intermediate layer 2 and outsole 3. In the arch area of the sole however, the order of the layers is: strobel sole, PU, shank 4, PU, and TPU intermediate layer 2. As there is no shank material in the opening 8 of the heel, this area is more flexible.

In order to lower the hardness in the heel area even further, a comfort element 9 (FIGS. 2*a* and 2*b*) can be placed in the cavity. In this embodiment, the PU only fills the opening 8 of the shank. Such comfort elements are well known and commercially available. The comfort element is 9 millimeters in height, the PU midsole below is 8 millimeters, the TPU intermediate layer 1 millimeter and the discrete rubber outsole 3 is 2 millimeters. The ratio between the height of the comfort element and the PU midsole below can be varied in a wide range, but should not exceed 1.5:1. Otherwise, the design would approach the conventional cushioning techniques, which as already described has drawbacks Advantageously, the PU bonds to the comfort element, hereby ensuring a fixation of the material without any further manufacturing steps.

Referring to FIG. 3*b*, a transition zone 39 in the shank between the arch area and the heel area should preferably not make an angle β of more than 50 degrees with the horizontal plane of the offset heel area. A larger angle provides discomfort to the runner due to a sharp edge. Advantageous angles are around 30 degrees. FIG. 3*c* shows the shank in a rear view. The transition zone 39 not only slopes from the arch area towards the heel area, but also from the medial side of the shank to the lateral side. In this way the shank is raised to give support to the arch of the foot.

The shank 4 is in both embodiments (i.e. cavity fully or partly filled with PU) fully or partly embedded in the PU midsole. In the forefoot and in the arch area, the shank is placed close to the strobel sole, either with or without PU in between strobel sole and shank. In the offset heel area the shank is placed close to the outsole.

Thus, by offsetting the longitudinally extending shank in the heel area of the sole, a cavity in the heel zone is created. This offset heel area has a platform on which the PU from the midsole is embedded during the injection process. The PU enters the cavity through a hole made in the platform, or, more precisely, through an opening made in the offset heel area of the shank. The heel area is offset towards the outsole to a second horizontal plane different from a first horizontal plane of the arch area of the shank. Our tests have shown, that this design gives a better running experience because the heel area of the sole has become softer.

A special insole has been provided. The insole consists of two layers. The upper layer is a polyester material, which is lightweight, and breathable. The bottom layer is made in two versions. For class A runners the bottom layer consists of EVA, which advantageously has a low weight, and for class B runners the bottom layer is made of PU foam. This is a more expensive solution, but gives a better insole. The bottom layer has through-going holes for breathing. In the heel portion of the insole an area with shock absorbing material is placed, and in the forefoot area of the insole an energy return material is placed which during push off releases most of the energy received during heel strike and full foot contact. Instead of placing the shock absorbing material in the insole it can also be embedded during the injection process in the heel of the midsole 1.

The inventive midsole 1 is shown in FIG. 4 with a direct view from the bottom. The midsole has a forefoot portion 23, a top end 22, a lower heel portion 20, an arch portion 21 and a lateral side portion 24. Four flex grooves 27, 29, 31 and 34 traverse the forefoot 23. The grooves have a depth of approximately 50-60% of the thickness of the forefoot midsole, in this example 3-4 millimeters. A curved flex groove 63 extends from the medial side 49 of the arch portion 21 and continues along portions 48, 32, 59, 60 and 61. The flex grooves create protrusions or pads 26, 28, 30, 33, 35, 38, 40, 46, 50, 52, 54, 56, 62 which in shape correspond to the shape of the discrete outsole elements 3 but have a larger area. Thus, the pads are closer to each other than the discrete outsole elements mounted on the TPU intermediate layer 2. As will be described later, this has shown to have a positive effect on slip resistance. Pads 33 and 35 are extended in the lateral horizontal direction to become the most extreme points on the lateral side of the sole. When outsole elements are placed on the pads, this extension will contribute to stabilizing especially when the foot supinates. A reinforcement bar 47 runs slanted from the medial side to the lateral side. The reinforcement bar is part of the midsole and made during the injection process. It is thicker than the midsole on the lateral portion 37 and on the medial portion 49, and adds stiffness to the midsole. It runs parallel with the shank 4 (not visible on FIG. 4) which is placed on the other side of the midsole, i.e. the side facing the foot.

The curved flex groove is substantially wider than the other flex grooves. In one embodiment it is six millimeters wide, the flex groove 34 three millimeters and the flex groove 31 four millimeters. As a rule, the curved flex groove is between 1.5 and 3 times wider than the other flex grooves. The width of the curved flex groove can be varied, but it has preferably a width corresponding to 1-2 times the distance between the third and fourth metatarsal phalanges. However, the distance may not be too wide because this would cause too much flexibility. Further, the flex groove has essentially a constant width along its curve in the forefoot.

The curved flex groove 63 intersects the transverse flex grooves 29, 31 and 34. The curved flex groove thus runs in longitudinal direction from the medial side of the arch to an apex point 59 in the metatarsal zone of the foot. From this apex point the groove continues in the opposite direction along path 60 and crossing flex grooves 57 and 55. It ends approximately under the ball of the big toe in flex groove 61. The curvature of the groove in essence gives the sequence of midsole pads a spiral shaped character: Thus, starting in an origo point O in pad 62, a curve 64 can be drawn which describes a somewhat compressed or eccentric spiral graph. When mounted later in the manufacturing process, the discrete outsole elements 3 will describe the same curve.

The function of the curved flex groove 63 is to enable natural running by giving the midsole a bending line in longitudinal direction between the fourth and the fifth metatarsal phalanges and hereby giving the characteristic "2-3 split" of the rays of the foot attention. This will be detailed in the following. FIG. 5 shows the bones of a right foot from the medial side with first metatarsal phalange 85, calcaneus 69, the tuberosity 68 and the superior tuberosity 67. FIG. 6 shows a right human foot from below. Reference number 70 describes the talus, 71 the navicular bone, and 72, 73 and 74 the three cuneiform bones, i.e. the medial, the intermediate and the lateral cuneiform bone respectively. Line 89 represents a folding line in the human foot between cuboid bone 87 on the one hand, and the lateral cuneiform bone 74 and the navicular bone 71 on the other. The foot is flexible and bendable along this folding line meaning that if bending is made along a longitudinal axis running between the fourth metatarsal phalanges 82 and the third metatarsal phalanges 83, the three most medial phalanges (83, 84, 85) will bend to one side, and the two most lateral phalanges (81, 82) will bend to the other side. Recognizing this bending line by allowing the sole to be bent along this axis enable the supinating and pronating muscles to compensate faster after heel strike in the situation where the foot either pronates or supinates. Thus, in the case of a too large pronation, i.e. the case where the arch of the foot is moved to the medial side, the supinating muscle flexor hallucis longus will counteract by a plantar flexing reaction on the medial side of the foot. According to the invention, counteraction will be faster with a sole having a curved flex groove and independent midsole pads and discrete outsole elements because musculus flexor hallucis does not have to "lift" the whole sole, but only a part of it, namely the part on the medial side of the curved flex groove, i.e. the part which comprises the first, second and third metatarsal phalanges. This supinating counteraction happens in order to get the ankle into neutral position where ideally no supination or pronation exists.

The outline of the curved flex groove 63 is shown with the line 90 in FIG. 6. This line shows where the curved flex groove is placed in the midsole 1. Note that the flex groove 63 is placed on the side of the midsole facing the outsole. Curved flex groove 63, represented by line 90 in FIG. 6, emanates from the medial side of the arch and starts under the navicular bone 71. Alternatively the medial cuneiform bone 72. It crosses the lateral cuneiform bone 74 and continues between the third and fourth metatarsal phalanges up to the beginning of the joints between the metatarsal and proximal phalanges (75, 76, 77, 78, 79). These joints are shown by line 92, which also represents flex groove 31 in FIG. 4. The curvature of line 90 (i.e. groove 63) in the region of the cuneiform bones can be changed. Also the starting point of the curve on the medial side can be raised towards the toe end or lowered towards the heel.

Turning back to FIG. 4, an ideal landing point A is shown in the lower heel portion. This point is the optimum point of landing for a runner, and it is placed just below the calcaneus, offset to the lateral side. Real life test shows however that in practice this optimum landing point cannot be reached. Typically, real life runners touch ground somewhere along the line marked B, reference number 41. The point of landing is dependent on the speed of running, and may even be different from right foot to left foot. However, moving the point closer to A results in improved force and energy consumption, and tests have shown that the point of landing with the sole can be moved to approximately C shown in FIG. 4. The basic idea with moving the point of landing as close to A as possible is the recognition that the muscles in the leg responsible for propulsion can be activated at an earlier time to become mechanically active—they are earlier in tension and able to create forward propulsion. In order to move this landing point as close to A as possible, two measures have been taken in the design. First, the height of the heel has been lowered or more specifically, the height of the lower heel portion 20 has been lowered in order to get the human foot as close as possible to the ground. Compared to state of the art running shoes, this height can be reduced, because the inventive design does not make use of extra cushioning materials in the sole. Cushioning is an inherent characteristic of the PU midsole material used. In general, cushioning should not be avoided but kept to a minimum because it absorbs energy without returning it to the foot. In the preferred embodiment the maximum height or thickness of the midsole in lower heel portion 20 is between eight and twelve millimeters, preferably eight millimeters. This is the heel spring of the midsole and corresponds to the thickness of the heel in point A of FIG. 4. The second measure taken in order to move the point of landing closer to A is by designing the lower heel portion 20 of the midsole 1 with a double tapering. FIG. 14 shows the rear of the foot 150 wearing a shoe with the inventive midsole 1 and discrete outsole element 124. The midsole in the rear foot area is asymmetrical around a vertical line B-B dividing the midsole into two halves. In the optimum upright standing position, the vertical axis B-B would go through the ankle joint and the tibia. The midsole is split into a medial heel portion 143 and a lateral heel portion 151. Further, a horizontal line C-C divides the midsole in the rear foot area into the lower heel portion 20 and an upper heel portion 142. The lines B-B and C-C together divides the heel of the midsole into four sections: I, II, III and IV. It is clear from the drawing that none of the four sections I-IV are identical. The tapering 141 enables the foot to touch down in point C (FIG. 4). As seen in FIG. 14, the tapering is not only in section III, but also partly in section IV. In section IV, i.e. on the medial side of lower heel portion 20, the tapering stops, and becomes aligned with a geometric plane corresponding to the geometric plane of surface 149 (FIG. 10). FIG. 10 shows the tapering in more detail, and it will be understood that the tapering not only runs from the centre of the lower heel portion 20 towards the lateral side as depicted in FIG. 14, but also from the centre towards the heel end. FIG. 11 shows with reference number 153 that on this point of the medial inner side of the heel, the lower heel portion has full contact with the ground via an outsole element. Supports 147 are an integral part of the midsole.

On heel strike, the midsole and outsole is designed to allow so called horizontal flexing. This is achieved with the curved heel flex groove 45 of FIG. 4, which groove is deeper and wider than the transverse flex grooves in the forefoot, and has the function of decoupling the heel of the sole from the forefoot sole in order to allow "horizontal flex", i.e. in order to allow horizontal movement of the heel portion especially during heel strike. This functionality can be compared to the human fat padding in the heel area which also allows a small horizontal movement back and forth. A second curved heel flex groove 42 is decoupling the pad 40 from the pad 38 at heel strike. Preferably, one discrete outsole element is applied to pad 40 and another element to pad 38. Pad 38 and pad 46 are fully horizontal, i.e. when the discrete outsole elements have been applied, these elements have full ground contact and are not curved as pad 40. The full ground contact of pad 46 is important to reduce the effects of overpronation, i.e. the situation where the foot continues pronating during the mid-stance. The double tapering of pad 40, as already described, is delimited by the second curved heel flex groove 42 from where the tapering starts. Also in points 43 and 44 pad 40 is tapered.

In FIG. 15 a second embodiment 168 of the heel of the midsole is shown. The lower heel portion 20 is provided with steps 169, 170 and 171. These steps are staggered in relation to each other and made as part of the midsole in PU. The staggered steps 170 and 171 are made in order to stiffen the lower heel portion. Such stiffening effect is provided by direct injected PU in edge zones. Step 169 which is also shown in FIG. 14, clearly extends longer to the lateral side than the rest of the midsole in the heel portion, e.g. as compared to support arm 145, and is provided to achieve enhanced stability. It will be noted from FIGS. 14 and 15 that the medial heel portion 143 essentially can be aligned with a vertical line D, whereas the lateral heel portion 151 is aligned with a slanted line E.

Comparative tests between the inventive running shoe and a state of the art running shoe have been made. 12 male test persons were using the inventive shoes and the state of the art shoes. Using a goniometer placed on the heel of the persons, foot switches for detecting ground contact and an accelerometer mounted on the tibia muscle, different parameters as angles, velocities and accelerations have been measured. Table 1 shows the comparative test results.

TABLE 1

| Comparative test | Inventive shoe | State of the art running shoe |
|---|---|---|
| Rear foot angle at touchdown (negative angle = inversion) | −3.4° | −2.8° |
| Maximal rear foot angle (positive angle = eversion) | 10.2° | 10.1° |
| Rear foot angle velocity at touchdown | 175°/s | 340°/s |
| Maximal rear foot angle velocity | 390°/s | 480°/s |
| Mean rear foot angle velocity | 200°/s | 290°/s |

The rear foot angle at touchdown was a bit larger than in the state of the art shoe. Thus the heel as a mean value was turned 3.4° to the lateral side measured in relation to the ideal zero degree situation. The maximal eversion angle on the other hand was found to be 10.2° as compared to 10.1° of the state of the art shoe. The maximal eversion angle is the angle measured when the heel of the foot turns to the medial side. Of particular interest are the velocity dynamics during touchdown, where the maximal rear foot angle velocity is 390°/s (degrees per second) as compared to 480°/s on the state of the art shoe and the mean rear foot angle velocity 200°/s as compared to 290°/s. In the eyes of the applicant this is a significant difference, because the lower mean and maximum velocity results in a more stable shoe. This means that from the instant the heel hits the ground until eversion is finished, the inventive shoe is significantly slower and thus more stable. The result is a reduced risk of injuries in the ankle. The low mean rear foot angle velocity is partly due to the fact that the shoe has a low heel which advantageously brings the foot very close to the ground.

FIG. 7 shows a second embodiment of a midsole 118 slightly modified in comparison to midsole 1 of FIG. 4. Apart from the modified midsole, FIG. 7 departs from FIG. 4 in that the midsole 118 has discrete circular outsole elements (101, 102, 104, 105, 106, 108, 110, 111, 112, 114, 115) mounted on the midsole. Further, FIG. 7 shows the curved flex groove as reference number 103 following a path 119 up to transversal flex line 113 and 107. This flex line corresponds to line 92 in FIG. 6. Also in the embodiment of FIG. 7, an imaginary eccentric spiral curve can be drawn starting with an origo O (curve not shown) in outsole element 105 and continuing via 104, 106, 108, 110, 111, 112, 114 and ending at 115, hereby curving around the curved flex groove 103. Also here, the outsole elements are discrete. Thus, elements 104, 105 and 106 although bridged by connection 109, can be made as isolated outsole elements. Element pair 108, 110 is another discrete outsole element. FIG. 7 shows that the curved flex groove 103 can stop at the level of flex line 113. This sole design will also contribute to increased flexibility of the foot and faster reaction to excessive supination or pronation. In the heel portion a tapered area 117 enables moving the point of landing closer to the centre of the heel sole. An outsole element 100 is spaced apart from a reinforcement bar 99 by a heel flex groove 116.

Improvements can be reached by further continuing the curved flex groove. Turning back to FIG. 6, the curved line 90 continues as curved forefoot line 91 across the third and second proximal phalanges and makes a U-turn in the direction of the heel. The curve 91 now runs in an opposite direction between the first and second metatarsal phalanges. This trajectory is also the one shown in the midsole of FIG. 4 and corresponds to the one seen in FIG. 8.

In more detail, FIG. 8 shows a third embodiment of the inventive midsole, which in the figure has a TPU intermediate layer 2 and discrete outsole elements (120, 121, 122, 124, 125) fixated. The discrete outsole elements function as the tread of shoe. Due to the flex grooves between the discrete outsole elements, the total outsole area is small compared to conventional outsoles. This has an effect on the slip resistance. The outsole area, which can also be perceived as a contact area between outsole and ground, has been further minimised by removing material from the central portion of the outsole elements. More specifically, the contact area of an outsole element in the elements of FIG. 8 is the area close to the edge of the element, whereas the centre of the outsole element is either devoid of material or only having a small contact area. Removing material from the outsole elements has the advantage of reducing the weight of the shoe, which is of particular interest in running shoes. Despite this reduction and the small surface area, a surprising effect has been seen regarding icy surfaces, because the grip of the sole has been improved compared to conventional soles. This is partly due to the material of the sole which is as mentioned rubber, and partly due to the "islandic" structure of the sole. As an example, the discrete outsole element 125 of FIG. 8 has a first plane surface 126 and a second plane surface 127. The second surface is lowered in relation to the first surface and a third surface 128 is in the same plane as the first. A fourth plane surface 133 constitutes the surface of the TPU intermediate layer 2, and is lower than plane surfaces 126 and 127. The surface area 133 essentially corresponds to the surface area of a pad of the midsole (see pad 35 in FIG. 4), albeit a bit larger due to the TPU intermediate layer which is covering the pad. As can be seen on FIG. 8, the discrete outsole element 125 covers a smaller area than the corresponding pad in the midsole. This means that neighbouring discrete outsole elements have a larger distance to each other than the pads in the midsole as can be seen by comparing the distance between outsole elements 125 and 123 of FIG. 8. In the current embodiment, the distance between outsole elements 123 and 125 is five millimeters, and the distance between element 122 and 125 ten millimeters. The relatively large distance between the discrete outsole elements increases the flexibility of the sole, and has, as already described, led to good characteristics on slip resistance. Further, by making the area of an outsole element smaller than the corresponding area of TPU intermediate layer and pad, peeling effects on the outsole elements can be avoided. They will be less inclined to loosen as the bonding between TPU and rubber is made on a plane surface away from edges of the surface 133.

The discrete outsole element 125 has sharp edges in an angle of about 90 degrees. When walking on an icy surface, the sharp edges penetrate the ice which creates a better grip. The total length of the sharp edges amounts to the sum of the circumference of the discrete outsole elements. The longer, the better grip one gets. However, with the invention, the grip has been even further improved. Without being bound by the following theory, it is believed that the flexible discrete outsole elements allow the foot to react in a natural way in the case of an icy surface. If you slip on one part of the foot base, the human brain will via a muscle action instruct another part of the same foot base to instantly and automatically compensate and try to get a grip on the ground. Conventional outsoles prevent this compensation because the compensational muscle reaction is constrained by the normal sole. A discrete outsole as in the invention, however, having flexible outsole islands, allows the discrete action of one or more of the 32 muscles in the foot. The improved gripping characteristic of the inventive sole was confirmed in laboratory tests in comparison with state of the art running shoes. Slip resistance showed to be improved both in relation to a wet surface and in relation to an icy surface. An improvement in slip resistance of the embodiment of FIG. 8 can be made by building channels 129 into the first surface 126. On wet surfaces, aqua planning can arise because water is trapped in the groove of the lower second surface 127. Channels 129 will allow the water to escape, hereby lowering the risk of aqua planning and increasing the slip resistance even further.

FIG. 9 shows a fourth embodiment of an inventive midsole 135, which midsole has a TPU intermediate layer 2 and an alternative tread. Discrete outsole element 130 exhibits undulating channels 131, which acts as grooves transporting the water away. Typically, grooves of one millimeter are used. The embodiment in FIG. 9 shows the use of a mixture of the outsole elements of FIGS. 8 and 9. The discrete outsole element 132 in the lower heel portion exhibits undulating channels in a direction slanted to the longitudinal direction of the sole.

FIG. 10 shows in a lateral side view an embodiment of the midsole 135 with discrete outsole elements 139 and a TPU intermediate layer 134. The heel end 137 extends vertically to a top point 152 on the medial side of the midsole and to a lower point 140 at the centre of the heel end 137. The top or apex of the upper heel portion is approximately at the same level as the instep of the shoe upper, see FIG. 12. The upper heel portion thus extends to the location where the Achilles' tendon is fixed to the calcaneus, and the upper heel portion essentially covers the tuberosity of the calcaneus on the medial and the lateral side. An opening 144 is made on the lateral side in order to increase flexibility by lowering the structural support given in this area. However, in principle the whole calcaneus can be supported by the vertically extended midsole material. The heel is extended vertically to a point essentially corresponding to the superior tuberosity of the calcaneus, see reference number 67 in FIG. 5. A support arm 145 connects the heel end 137 with the lateral heel portion 151, and ensures stability. By extending the heel of the midsole into an upper heel portion which forms an integrated entity with the midsole (preferably as described injection moulded), the heel cap of traditional shoes can be omitted, hereby simplifying the shoe and reducing weight and cost. In an exemplary embodiment the vertical height measured from the geometric plane corresponding to surface 149 to lower top point 140 is 61 millimeters. With TPU intermediate layer 2 and discrete outsole elements mounted the height becomes 65 millimeters.

On the lateral side of the midsole 135, a measure is taken to compensate for the proximal head of the fifth metatarsal phalanges which causes a protrusion or a local extremity of the foot, also known as tuberositas ossis, see reference number 86 in FIG. 6. This head, if encapsulated by a relatively stiff sole material, will be subjected to friction between head and sole material, and will reduce the flexibility of the shoe. In order to avoid this friction and to allow the head and the joint free movement, an opening or window 148 as shown in FIG. 10 is created in the midsole material. Thus, in this area of the midsole, the midsole is devoid of sole material.

FIG. 11 shows midsole 135 from the medial side with the large support area of the medial heel portion 143. As described, top point 152 is in the area of the superior tuberosity of the calcaneus. From this point, the edge of the midsole of the medial heel portion degrades in a direction towards the toe end along a curve 154 via supporting arm 155 to the forefoot. A corresponding support arm is found on the lateral side, reference number 156 (FIG. 10). Thus the midsole 1 is raised vertically on the lateral side and on the medial side with the idea of supporting the foot by using support structures 157 and 158 respectively. These structures give the medial upper arch an elastic and adjustable support. Thus, support structure 158 adds support shortly after heel strike e.g. in a case where the foot tends to pronate. The support is achieved because the PU material of the midsole has sufficient mechanical strength to exert a stabilizing force. In principle the support structure 158 could be made without window 159, but the supporting arm 155 has proved to give sufficient support. Additionally, structural element 160 has been added for further reinforcement. The vertical height of support structure 158 extends up to or above the upper half of the navicular bone 71 and medial cuneiform bone 72, and support structure 158 extends in longitudinal direction to approximately the start of the first metatarsal phalanges.

Preferably, the support structures 158 and 157 are inclined inwardly to follow the shape of the foot. As the support structures are an integrated part of the midsole and thus made of polyurethane in the preferred embodiment, the support structures have the same material characteristics as PU and are thus able to keep the inclination during use and to exert a pressure against the upper 166 and the arch. The lateral and medial support structures are bonded to the upper in a polyurethane injection process.

Toe end 36 (FIGS. 1*a*, 1*b*, 2*a*, 2*b*, 10, 11, 12 and 13) is likewise bonded to the upper in the injection process, and forms an integrated part of the midsole. The toe end is materially connected with the support structures 163 and 162 through a rim in the forefoot area, and is extended vertically from the base of the midsole 1 and curved inwardly and pointing towards the heel. The design of this integrated toe cap follows the general inventive concept, namely to increase the supporting material surface on the medial side as compared to the lateral side. Thus, as shown on FIG. 11, toe end 36 covers on its medial side an area larger than on the lateral side as shown in FIG. 10. The extended toe end 36 is offset from a longitudinal centre line through the midsole to the medial side, and stabilizes the foot during running and protects the toes and the upper.

FIGS. 12 and 13 show an even further embodiment of a midsole 161 provided with an upper 166. Support structures 162 and 163 are in this embodiment made as a supporting mesh with openings 164 and 165. Looking at the medial side in FIG. 12, sufficient structural support is ensured by support arms 172 extending upwards to the lacing area 173 and creating crossing sections 167, 172. The support structure 163 describes a structural mechanical stabilizing connection between the medial heel end and the medial forefoot, which ends in the upwardly extending toe end 36.

The described embodiments can be combined in different ways.

The invention claimed is:

1. A midsole for a shoe including an outsole configured to contact ground when the shoe is worn during walking and an upper adapted to receive and hold a foot of a wearer, the midsole comprising:

a toe end;

a heel end;

a forefoot portion disposed proximate to the toe end;

a heel portion disposed proximate to the heel end;

an arch portion disposed between the forefoot and heel portions wherein the heel portion includes a lower heel portion configured to be disposed proximate to the outsole and an upper heel portion extending vertically upward from the lower heel portion to a point configured to substantially correspond to a superior tuberosity of the wearer such that the upper heel portion is configured to cover a tuberosity of a calcaneus of the wearer;

wherein the upper heel portion is asymmetric about a vertical axis dividing the midsole into two halves: a medial half and a lateral half;

wherein the medial half extends vertically from the lower heel portion to an upper terminal edge of the medial half;

wherein the lateral half extends vertically from the lower heel portion to an upper terminal edge of the lateral half and includes an opening formed through the lateral half of the upper heel portion;

wherein the medial half of the upper heel portion has a first stiffness and the lateral half of the upper heel portion has a second stiffness, the second stiffness being less than the first stiffness due to the opening formed through the lateral half; and wherein the midsole is a single, integrally formed, monolithic structure which extends continuously from the toe end to the heel end and through the lower and upper heel portions to the upper terminal edges of the medial and lateral halves;

wherein the upper terminal edge of the lateral half of the upper heel portion is vertically lower than the upper terminal edge of the medial half.

2. The midsole of claim 1, wherein the upper heel portion is adapted to follow heel motion of the wearer and provide support to a medial part of the heel during an initial heel strike when a foot of the wearer moves from a lateral side to a medial side into pronation.

3. The midsole of claim 2, wherein an area of the midsole on the medial side of the upper heel portion is larger than an area of the midsole on the lateral side of the upper heel portion to provide said support to the medial part of the heel.

4. The midsole of claim 1, wherein the medial half of the upper heel portion is larger than the lateral half of the upper heel portion.

5. The midsole of claim 1, wherein the medial half of the upper heel portion is configured to cover a larger area of the tuberosity of the calcaneus of the wearer than the lateral half of the upper heel portion.

6. The midsole of claim 1, wherein the medial half of the upper heel portion extends continuously and uninterrupted from the lower heel portion to the upper terminal edge of the medial half.

7. The midsole of claim 1, wherein the single, integrally formed, monolithic structure comprises a polyurethane material.

8. The midsole of claim 7, wherein the polyurethane material is a light polyurethane material having a density of about 0.35 g/cm$^3$ and a Shore A hardness of about 38 to about 40.

9. The midsole of claim 1, wherein the opening formed through the lateral half of the upper heel portion delimits a support arm proximate to the upper terminal edge of the lateral half, the support arm defining an upper end of the opening and the support arm being configured to provide lateral support to a heel of the wearer.

10. The midsole according to claim 1, wherein the lower heel portion is asymmetric about said vertical axis.

11. The midsole according to claim 10, wherein the midsole in the lower heel portion has a plane surface and a tapered surface and the tapered surface is tapered away from a geometric plane of the plane surface towards the upper heel portion.

12. The midsole according to claim 1, wherein a lateral side of the lower heel portion extends laterally longer than the lateral half of the upper heel portion.

13. The midsole according to claim 12, wherein said lower heel portion comprises steps staggered in relation to each other and following a path from a medial side of the lower heel portion to the lateral side of the lower heel portion.

14. The midsole according to claim 1, wherein the midsole is configured to extend vertically in a medial and a lateral area of a midfoot area, where a medial support structure is configured to supports a medial upper arch and a lateral support structure is configured to supports a lateral side of the midfoot area, the medial support structure covering an area larger than the lateral support structure.

15. The midsole according to claim 14, wherein the medial support structure comprises supporting arms, and openings devoid of midsole material.

16. The midsole according to claim 1, wherein the maximum thickness of the midsole in the lower heel portion is between eight and twelve millimeters.

17. The midsole according to claim 1, wherein the heel portion is disposed integrally with the arch and forefoot portions.

18. A midsole for a shoe including an outsole configured to contact ground when the shoe is worn during walking and an upper adapted to receive and hold a foot of a wearer, the midsole comprising:

a toe end;

a heel end;

a forefoot portion disposed proximate to the toe end;

a heel portion disposed proximate to the heel end;

an arch portion disposed between the forefoot and heel portions wherein the heel portion includes a lower heel portion configured to be disposed proximate to the outsole and an upper heel portion extending vertically upward from the lower heel portion to a point configured to substantially correspond to a superior tuberosity of the wearer such that the upper heel portion is configured to cover a tuberosity of a calcaneus of the wearer;

wherein the upper heel portion is asymmetric about a vertical axis dividing the midsole into two halves: a medial half and a lateral half;

wherein the medial half extends vertically from the lower heel portion to an upper terminal edge of the medial half;

wherein the lateral half extends vertically from the lower heel portion to an upper terminal edge of the lateral half and includes an opening formed through the lateral half of the upper heel portion;

wherein the medial half of the upper heel portion has a first stiffness and the lateral half of the upper heel portion has a second stiffness, the second stiffness being less than the first stiffness due to the opening formed through the lateral half;

wherein the midsole is a single, integrally formed, monolithic structure which extends continuously from the toe end to the heel end and through the lower and upper heel portions to the upper terminal edges of the medial and lateral halves;

wherein the upper terminal edge of the lateral half of the upper heel portion is vertically lower than the upper terminal edge of the medial half;

wherein the midsole is configured to extend vertically in a medial and a lateral area of a midfoot area, where a medial support structure is configured to support a medial upper arch and a lateral support structure is configured to support a lateral side of the midfoot area, the medial support structure covering an area larger than the lateral support structure; and wherein the medial support structure comprises supporting arms, and openings devoid of midsole material.

* * * * *